US005358462A

United States Patent [19]

Calderone

[11] Patent Number: 5,358,462

[45] Date of Patent: Oct. 25, 1994

[54] EXERCISE APPARATUS

[76] Inventor: Michael P. Calderone, 9080 Evergreen, Brighton, Mich. 48116

[21] Appl. No.: 180,109

[22] Filed: Jan. 12, 1994

Related U.S. Application Data

[63] Continuation of Ser. No. 67,178, May 24, 1993, abandoned, which is a continuation of Ser. No. 816,277, Jan. 3, 1992, abandoned.

[51] Int. Cl.[5] ..... A63B 21/00

[52] U.S. Cl. ..... 482/137; 432/97; 432/102; 432/139

[58] Field of Search ..... 432/93–94, 432/97–123, 133–139, 908

[56] References Cited

U.S. PATENT DOCUMENTS

| | | | |
|---|---|---|---|
| 4,266,766 | 5/1981 | Calderone . | |
| 4,336,934 | 6/1982 | Hanagan et al. | 482/97 X |
| 4,344,619 | 8/1982 | Szabo | 482/97 |
| 4,357,010 | 11/1982 | Telle | 482/97 |
| 4,455,020 | 6/1984 | Schnell | 482/106 |
| 4,563,003 | 1/1986 | Bugallo et al. . | |
| 4,627,614 | 12/1986 | De Angeli . | |
| 4,757,992 | 7/1988 | Heitsch et al. . | |
| 4,784,384 | 11/1988 | Deola . | |
| 4,863,161 | 9/1989 | Telle | 482/97 |
| 4,883,269 | 11/1989 | Shaver | 482/138 X |
| 4,923,195 | 5/1990 | Calderone . | |

*Primary Examiner*—Robert Bahr
*Attorney, Agent, or Firm*—Brooks & Kushman

[57] ABSTRACT

Two attachments are provided for an exercise apparatus of the type having a lever arm with an end pivotably connected to a base and a free end adapted to receive weights. A tower attachment provides a flexible tensile member connected at an end to the lever arm, with intermediate portions borne across elevated pulleys, and connectable at another end to various handles, by which a user can perform various pull-down and rowing exercises. A shoulder bar attachment has an elongated body connected at one end to the lever arm and having another end which accommodates the user's head and shoulders and which is provided with handles, allowing a user to perform various press and leg raise exercises.

5 Claims, 3 Drawing Sheets

EXERCISE APPARATUS

This application is a continuation of copending application Ser. No. 08/067,178, filed May 24, 1993, now abandoned, which in turn is a continuation of copending application Ser. No. 07/816,277, filed Jan. 3, 1992, now abandoned.

TECHNICAL FIELD

The present invention relates to the field of exercise apparatus and more particularly to attachments to an exercise apparatus, which attachments, in combination with the exercise apparatus allow more varied development of muscles of the upper body and the legs.

BACKGROUND ART

U.S. Pat. No. 4,266,766, issued to the inventor of the present application and incorporated by reference herein, discloses an exercise apparatus including a base and a pivoted lever arm pivotably connected to the base with a free lever end spaced from and extending generally transversely from the base. The free lever end is adapted to receive weights and a handle is attached to a point on the lever arm spaced from the pivotable connection by which a user of the apparatus may exert effort against the weights borne at the free lever end.

U.S. Pat. No. 4,923,195, also issued to the inventor of the present invention and incorporated by reference herein, discloses further refinements, including an adjustable forearm pad, which provide greater ease and flexibility of use of the exercise apparatus.

Similarly, the attachments of the present invention, including a tower attachment and a shoulder bar attachment, provide yet further ease and flexibility of use, expanding the number and kinds of exercises which a user can accomplish with the exercise apparatus, concomitantly expanding the range of muscles which can be developed with the apparatus.

SUMMARY OF THE INVENTION

The attachments of the present invention are adapted to be used in combination with an exercise apparatus of the type having a pivoted lever arm extending generally transversely from a base, the free lever end of the lever arm adapted to receive weights. The attachments of the present invention include an elongate tower attachment by which a flexible tensile member whose intermediate portion engages a pulley at a high end of the tower attachment, has a first end attached to the lever arm at a point spaced from its pivotably fixed end. The other end of the flexible tensile member is adapted to receive a plurality of handles including a pull-down bar and a rowing handle.

A second attachment of the present invention includes a generally elongate shoulder bar having at one end a means of pivotable connection to the lever arm at a point spaced from its pivotably fixed end of the lever arm. The second end of the shoulder bar is adapted to receive the head of a user between a pair of transversely extending handles. The shoulder bar provides means by which a user can accomplish a number of exercises including inclined presses at a plurality of angles and squats and calf raises.

Other advantages and applications of the present invention will become apparent to those skilled in the pertinent art when the following description for practicing the invention is read in conjunction with the accompanying drawings.

DESCRIPTION OF THE PREFERRED EMBODIMENT

Figures 1, 1A:
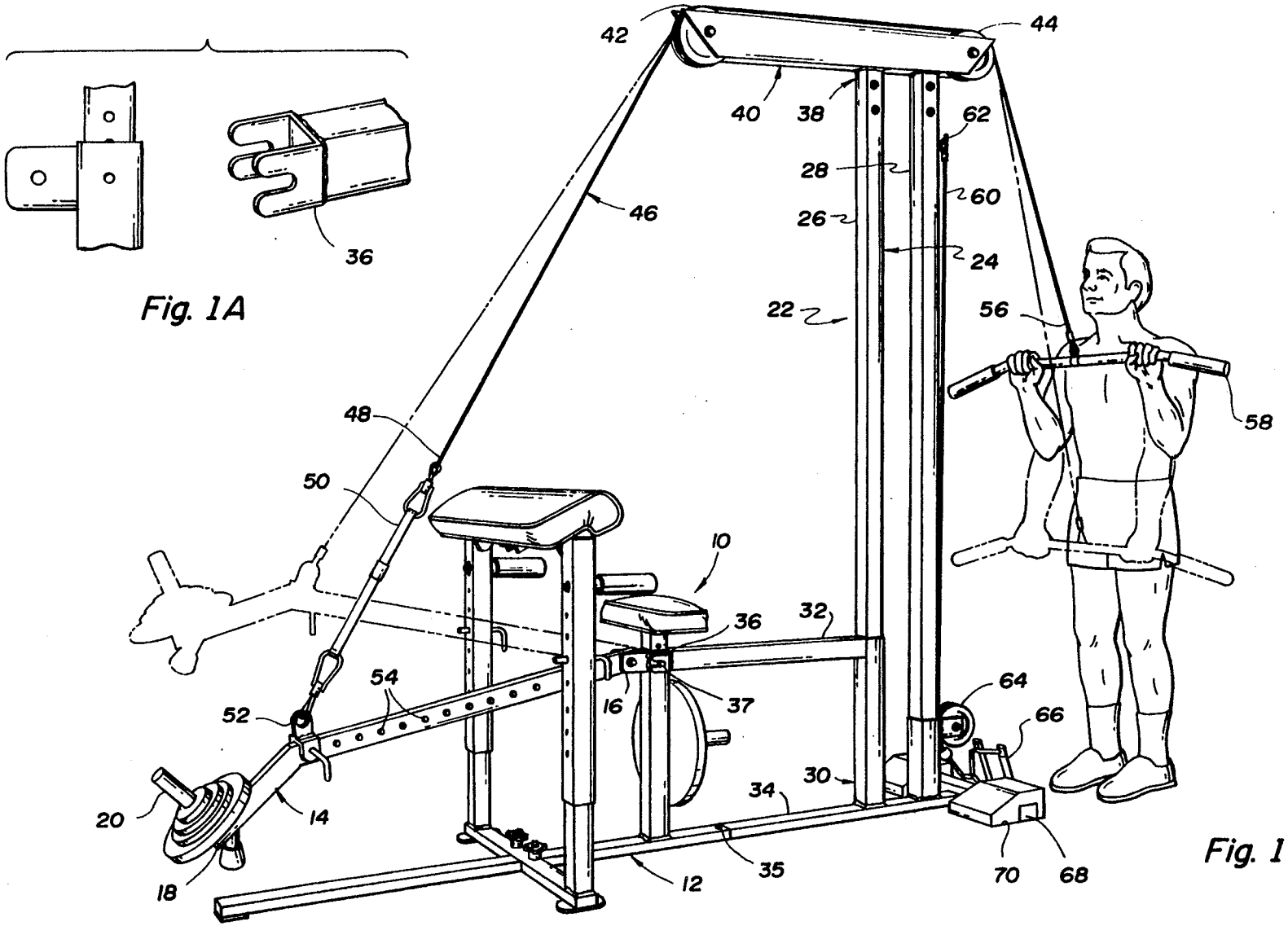
FIG. 1 illustrates a perspective view of the tower attachment of the present invention connected to a pivotable lever arm exercise device, with a user illustrating a pull-down exercise.
FIG. 1A is a perspective view of connection means for connecting the tower attachment to an upright portion, also illustrated, of the base of an exercise device.

FIG. 1 illustrates an exercise apparatus 10 of the type having a base 12 and a pivoted lever arm 14 pivotably connected at a fixed lever end 16 to the base 12. Lever arm 14 has a free lever end 18 which is forwardly spaced and extends generally transversely from base 12. Free lever end 18 is provided with a pin 20 which provides means for selectively receiving weights. In a preferred embodiment illustrated in FIG. 1, pin 20 extends generally upwardly to engage the center hole of standard annular free weights. It will be readily apparent to those skilled in the art that other means for selectively receiving weights at free lever end 18 also fall within the scope of the present invention.

The tower attachment of the present invention is generally designated 22 and has an elongate tower support 24 which, in a preferred embodiment illustrated in FIG. 1, comprises vertical columns 26 and 28, although those skilled in the art will readily appreciate that such tower support 24 could take many other forms. The tower attachment 22 has a low tower end 30, which in the illustrated embodiment includes an upper connecting arm 32 and a lower connecting arm 34, with pin 35, by which tower attachment 22 can be connected to base 12 of exercise machine 10. Those skilled in the art will readily appreciate that other design configurations for connecting elongate tower attachment 22 to base 12 fall within the scope of the present invention.

Upper connecting arm 32 is provided with connecting means 36 by which it can connect to elements of base 12. As best seen in FIG. 1A, the illustrated invention discloses that connection means 36 may be a slotted sleeve sized to engage a vertical post of base 12. A pin 37 passes through the slots of the connection means 36 and can receive any of a plurality of means by which the slotted sleeves may be tightened to the support element, such as a clamp or a winged nut where the pin is threaded. In the embodiment illustrated in FIG. 1, lower connecting arm 34 is provided with a free end sized to fit within an open end of a support element of base 12 and secured with a pin 35 or other removable fastener.

In a preferred embodiment illustrated in FIG. 1, a high tower end 38 of tower attachment 22 is provided with a horizontal support bar 40, having a pair of pulleys 42 and 44 at each end, respectively.

A flexible tensile member 46 has sufficient length to extend across pulleys 42 and 44 at the respective ends of horizontal support bar 40. A first end 48 of flexible tensile member 46 may include an adjustment strap 50 by means of which the effective length of flexible tensile member 46 may be selectively adjusted. As shown in the illustrated embodiment, adjustment strap 50 may be provided with articulating clips to attach to both first end 48 of flexible tensile member 46 and a connecting bracket 52, which may be selectively attached to a plurality of locations 54 disposed along lever arm 14 at positions distal from fixed lever end 16. Those skilled in the art will appreciate that other designs pivotably connecting affixing first tensile member end 48 to the plurality of spaced locations 54, both adjustably and unadjustably, fall within the scope of the present invention.

Those skilled in the art will likewise appreciate that alternative designs of high tower end 38 also fall within the scope of the invention, including for example, replacement of horizontal support bar 40 and its respective pulleys 42 and 44 with a single pulley disposed at a height sufficient such that flexible tensile member 46 has sufficient clearance over elements of exercise machine 10 such as the adjustable elbow pad illustrated in FIG. 1. Thus, the interrelated features which inform the many acceptable designs within the scope of this invention include the height of the tower support 24, the width of horizontal support bar 40, if any, the possibility of removal of any obstructions on exercise machine 10, such as the elbow pad, and the length of lever arm 14.

Furthermore, alternative embodiments of flexible tensile member 46 and the pulleys 42 and 44 which engage the intermediate portion of flexible tensile member 46 include flexible tensile member 46 being a cable and pulleys 42 and 44 having smoothed grooves to engage the cable, or flexible tensile member 46 being a chain and pulleys 42 and 44 being provided with teeth to engage said chain.

A second end 56 of flexible tensile member 46 extends below high tower end 38 and is adapted to engage a handle 58 such as a pull-down bar or to engage a second flexible tensile member 60. For this purpose, second tensile member end 56 or second flexible tensile member 60, or both, may be provided with a clip or other connector. It may be noted in FIG. 1 that tower support 24, and particularly vertical column 28 in the illustrated embodiment, may be provided with a storage means 62 such as a hook to selectively store either second flexible tensile member 60 or handle 58 when the other respective component of this pair is in use.

FIG. 1 further illustrates that low tower end 30 of tower attachment 22, and particularly vertical column 28 of tower support 24 of this embodiment, may be provided with a lower pulley 64 adapted to engage second flexible tensile member 60. The end of second flexible tensile member 60 which extends past lower pulley 64 includes connection means to selectively connect to a handle 66 such as a rowing handle. Low tower end 30 is also provided with a transverse foot block bar 68, which in turn engages a pair of foot blocks 70 by which a user may brace his feet during certain exercises such as a rowing exercise.

Figure 2:
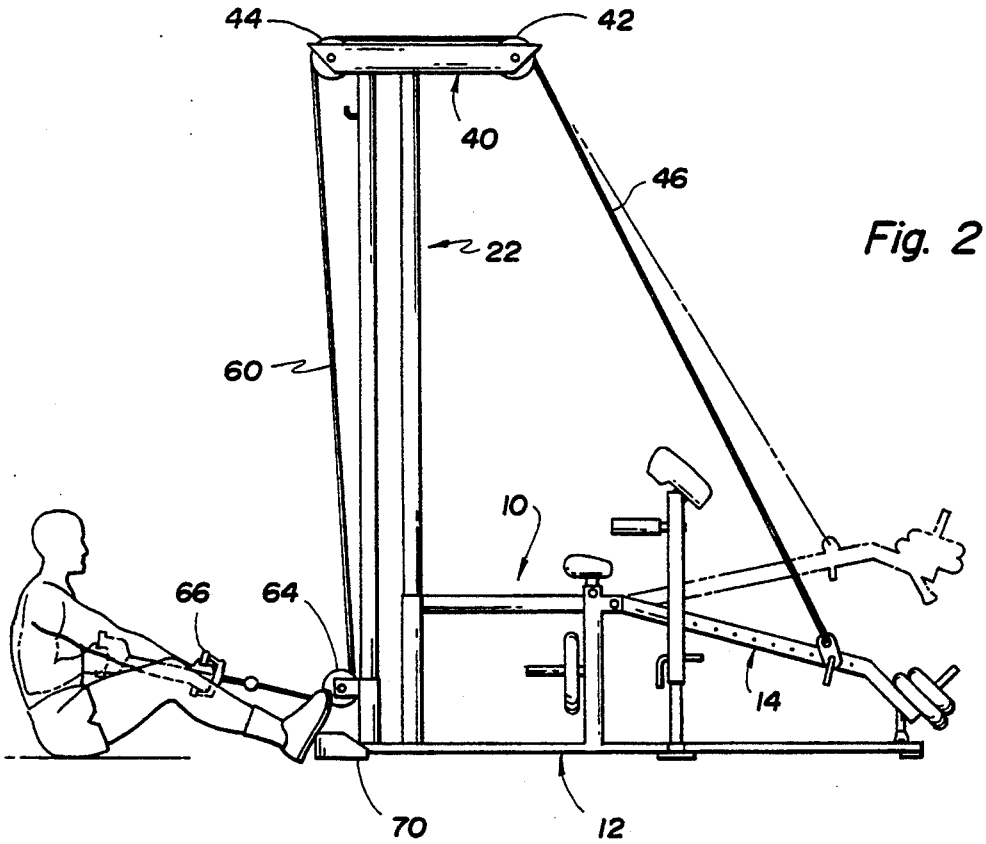
FIG. 2 is a side view of the tower attachment illustrating its use for a rowing exercise, with shadow line illustration of range of motion of both the pivoted lever arm and the user.

FIG. 2, in full and in shadow lines, show the operation of tower attachment 22 during a user's rowing exercise.

Figure 5:
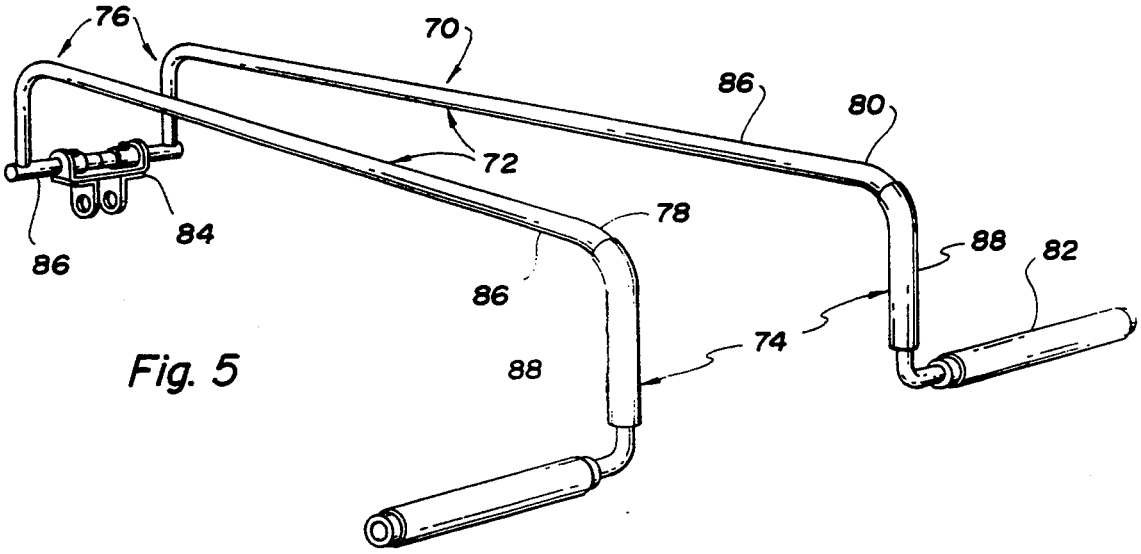
FIG. 5 is a perspective view of the shoulder bar attachment of the present invention.

A shoulder bar attachment, generally designated 70, of the present invention is best illustrated in FIG. 5. Shoulder bar attachment 70 has a generally elongate body 72 with a first body end 74 and a second body end 76. The central region of elongate body 72 between first end 74 and second end 76 is generally aligned along a longitudinal axis. In a preferred embodiment, the elongate body 72 may comprise a pair of elongate members 78 and 80, respectively, which are spaced apart at least a distance which is sufficient to form a central opening to accommodate the head of a user of the shoulder bar 70 as attached to exercise machine 10. A pair of handles 82 is preferably padded and rotatably mounted upon elongate members 78 and 80 at first body end 74, the handles 82 extending along a transverse axis which is generally perpendicular to the longitudinal axis of elongate body 72. The second body end 76 is provided with pivotable connection means 84 for pivotally connecting the shoulder bar attachment 70 to any of a plurality of locations 54 disposed along lever arm 14.

In a preferred embodiment illustrated in FIG. 5, pivotable connection means 84 comprises a bracket having a bracket arm and a rotatable sleeve which engages a connecting rod 86 disposed at second body end 76 and connecting elongate member 78 and elongate member 80. In an alternative embodiment, each of elongate members 78 and 80 may be a unitary tube whose ends at second body end 76 are connected by engaging a surrounding, rotatable sleeve upon which pivotable connection means 84 is disposed.

In a preferred embodiment illustrated in FIG. 5, elongate members 78 and 80 are a pair of tubes each of which is of generally elongated U-shape. Thus, elongate members 78 and 80 each have a first section 86 which is generally elongate and lies along the longitudinal axis of generally elongate body 72. Each of elongate members 78 and 80 additionally has a second section 88 which extends generally orthogonally to both first section 86 and handles 82. As seen in both FIGS. 3 and 4, the purpose of the orthogonally oriented second section 88 of elongate members 78 and 80 is to allow the first body end 74 of shoulder bar 72, which is the user's end, to accommodate the shoulder of the user, in turn allowing the handles 82 to be grasped forward of the user's torso.

Figure 3:
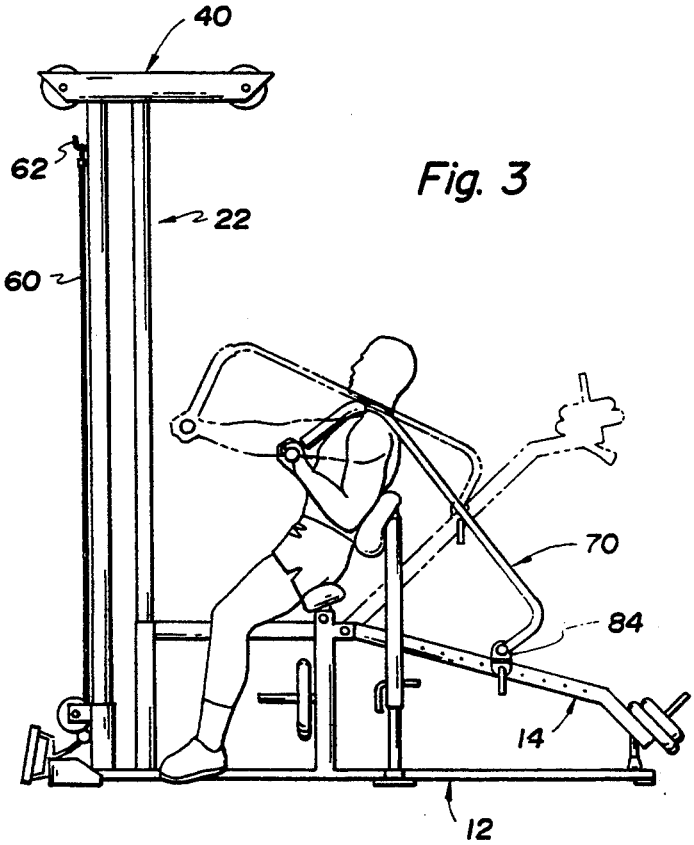
FIG. 3 is a side view of the shoulder bar attachment pivotably connected to the pivoted lever arm of an exercise device, with shadow line illustration of range of motion of both the exercise device and the user during an inclined press exercise.
Figure 4:
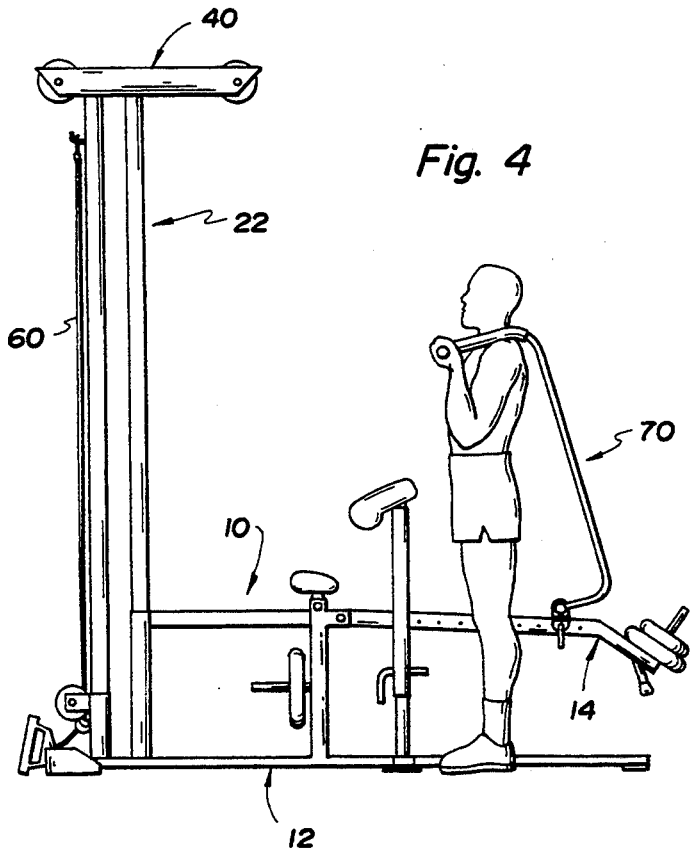
FIG. 4 shows a side view of the shoulder bar in combination with the pivoted lever arm of an exercise device during a squat or calf raise exercise.

As seen in FIG. 5, as well as in FIGS. 3 and 4, the second body end 76 of shoulder bar 70 is also provided with an orthogonal section similar to second section 88 of elongate members 78 and 80 and which, in combination with second section 88 give elongate members 78 and 80 its earlier described generally elongate U-shape. As best noted in FIG. 4, the orthogonal section at second body end 76 provides a similar function to orthogonal section 88 located at first body end 74, but with respect to accommodating the user's lower torso and legs.

FIG. 3 illustrates use of the shoulder bar 70 of the present invention, in combination with exercise machine 10, during an inclined bench press exercise. It should be noted that while the shadow lines of FIG. 3 show a bench press which brings the user's arm from the solid line position to a single extended position, an additional advantage of the pivotable connection means 84 is that the user can perform an inclined bench press at various angles within a wide range. As a result, the user has greater flexibility to gear development at variable precise portions of involved muscle groups.

While the best mode for carrying out the invention has been described in detail, those familiar with the art to which this invention relates will recognize various alternative designs and embodiments for practicing the invention as defined by the following claims.

What is claimed is:

1. An exercise apparatus having:

a base;

a pivoted lever arm pivotably connected at a fixed end to said base and having a free lever end forwardly spaced and extending generally transversely from said base;

an attachment having a generally elongate body with first and second body ends and a central region therebetween, aligned along a longitudinal axis, said central region adjacent the first body end including a pair of elongate members spaced apart sufficiently to form a central opening to accommodate the head of a user of said apparatus, each of said pair of elongate members being provided with a first section generally parallel to said longitudinal axis and a second section extending generally orthogonally to said first section and to said transverse axis to accommodate the shoulders of a user, said attachment pivotably connected at the second body end to said lever arm at a point spaced from said fixed end and pivotable toward said fixed end;

a pair of handles disposed at said first body end, affixed respectively to said pair of elongate members and extending along a transverse axis generally perpendicular to said longitudinal axis; and connection means for pivotably connecting said attachment to said lever arm.

2. The exercise apparatus of claim 1 wherein said body comprises a pair of generally parallel tubes defining said central opening therebetween.

3. The exercise apparatus of claim 1 wherein said handles are rotatably mounted at said first body end.

4. The exercise apparatus of claim 1 wherein said pivotable connection means comprises a rotatable sleeve mounted to said body and at least one bracket arm for connection of said attachment to said lever arm.

5. The exercise apparatus of claim 1 wherein said free lever end includes means for receiving weights.

* * * * *